US005996839A

United States Patent [19]

McLinn

[11] Patent Number: 5,996,839

[45] Date of Patent: Dec. 7, 1999

[54] GOLF BALL DISPENSER

[76] Inventor: Kris B. McLinn, 22213 6th Ave., South, #204, Des Moines, Wash. 98198

[21] Appl. No.: 08/762,461

[22] Filed: Dec. 9, 1996

[51] Int. Cl.[6] ..... B23Q 7/00

[52] U.S. Cl. ..... 221/174; 273/108.21

[58] Field of Search ..... 221/174, 185, 221/282; 273/118 A, 108.21

[56] References Cited

U.S. PATENT DOCUMENTS 2,684,782 7/1954 Lime et al. ..... 221/174

*Primary Examiner*—Kenneth Noland

[57] ABSTRACT

A portable tripodal support formed from a plurality of interconnected legs adapted to receive a flexible hopper for holding a supply of golf balls to be individually dispensed to a golf club striking position with one of the legs being the discharge chute for the golf balls.

5 Claims, 4 Drawing Sheets

GOLF BALL DISPENSER

BACKGROUND OF THE INVENTION

All golfers know what a tedious and laborious effort is required to individually tee or set up balls when practicing various shots. To provide relief in this situation many devices have been invented and patented to facilitate the dispensing of balls without the expenditure of a great deal of energy. These patents generally take the form of some type of support having a golf ball hopper associated therewith and means controlled by the golfer to selectively and individually dispense and position the ball adjacent the golf club head.

The golf ball dispenser of the present invention provides a simple and, therefore, economical device for accomplishing the same result, and is directed to a portable frame supporting a flexible container which houses a supply of golf balls to be individually dispensed as desired by the golfer.

SUMMARY OF THE INVENTION

The golf ball dispenser of the present invention is directed to a portable frame comprised of three legs of substantially equal length interconnected at their midpoints. When extended outwardly, the lower halves of said legs form a ground-engaging support and, simultaneously, the upper halves form a cradle adapted to receive a flexible bag for holding a supply of golf balls. One of said legs serves as a discharge chute having its upper end in communication with the ball supply, and its lower end adjacent the golf club striking area. A movable member disposed inside the chute and controlled by the golfer permits the individual dispensing of the balls thereby obviating the many steps required if the same were to be performed manually.

BRIEF DESCRIPTION OF THE INVENTION

Figure 1:
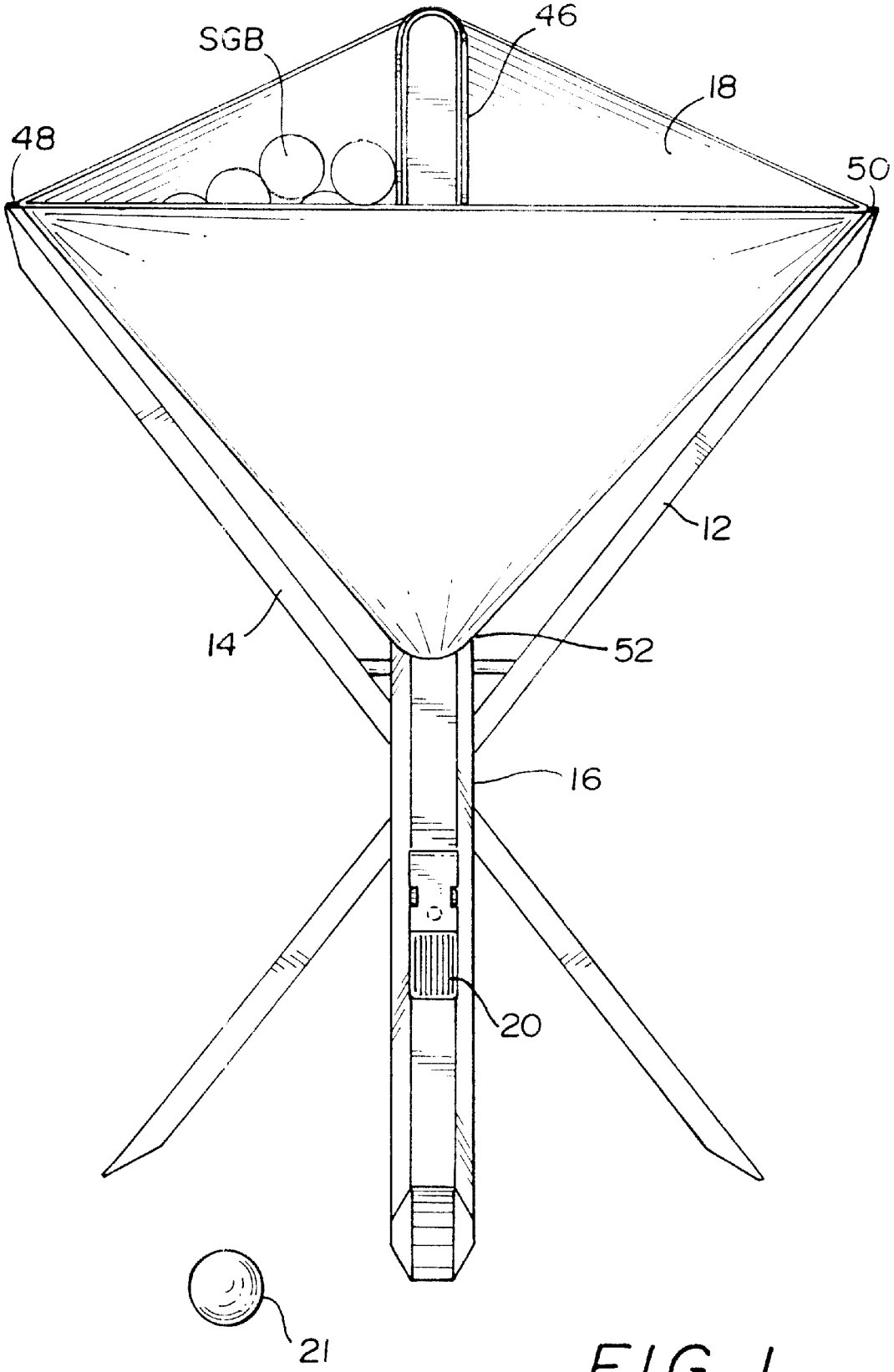
FIG. 1 is a perspective front view of the ball dispenser of the present invention.
Figure 2:
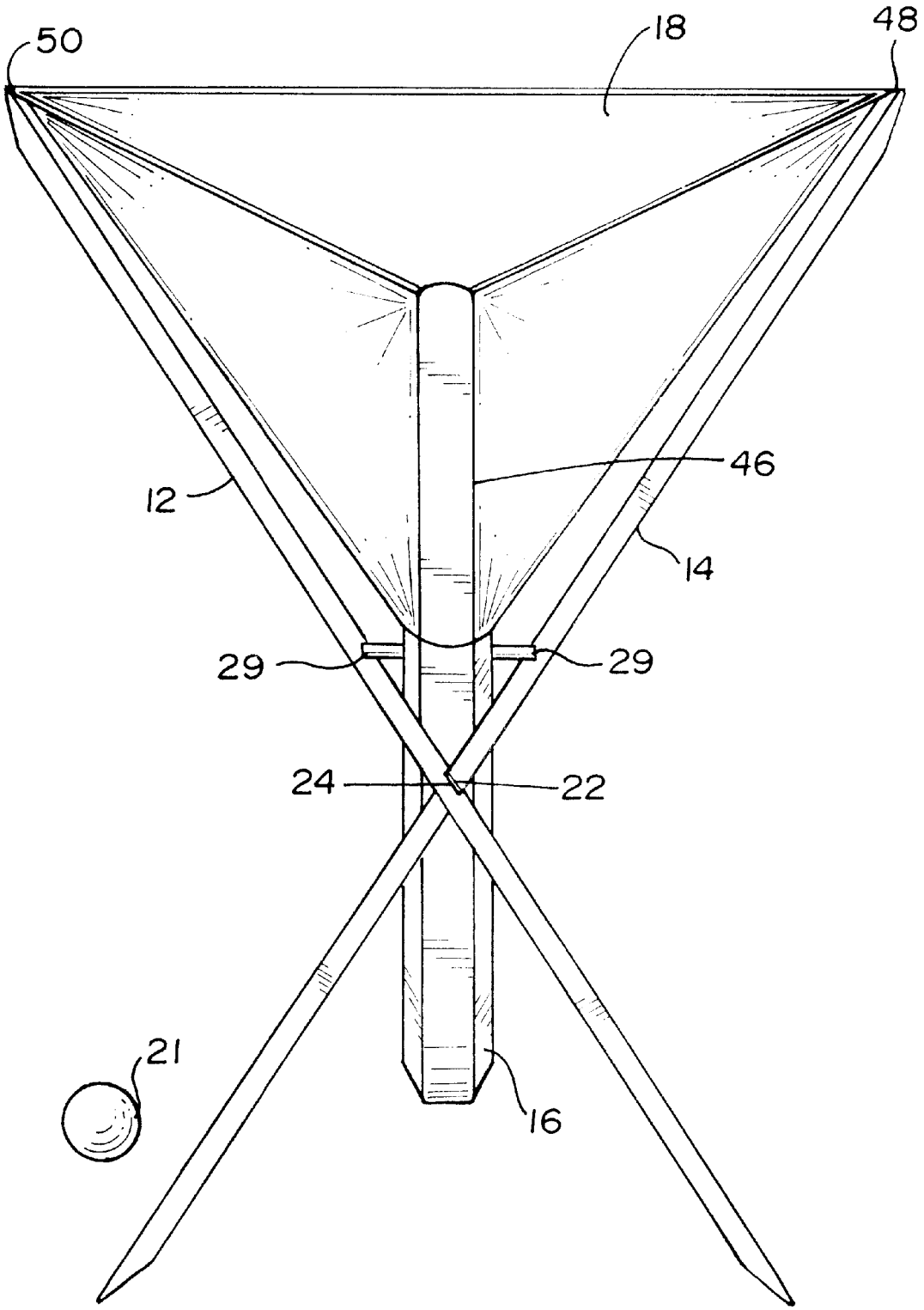
FIG. 2 is a perspective rear view of the ball dispenser of the present invention.

With reference to FIGS. 1 and 2, the golf ball dispenser assembly of the present invention is depicted generally as 10 and is seen to include support legs 12, 14 and 16, a flexible hopper 18 supported by the upper portions of the legs and adapted to hold a supply of golf balls SGB, and a discharge means 20 controlling the dispensing of individual balls through the leg 16 which doubles as a discharge chute.

As seen, legs 12, 14 and 16 are of substantially the same length differing only in that leg 16 is hollow and of a size to permit the passage of balls therethrough, in the present instant, golf balls. The legs 12, 14 may be formed from any material such as plastic, wood, metal or a combination thereof and may be of any cross-section configuration.

With continuing reference to FIG. 2, the legs 12, 14 are seen to be notched medially of their length at 22, 24 and interfitted to support one another when the assembly 10 is erected. It is considered to be within the purview of the present invention to use alternative means for securing the legs to one another, i.e., only one leg need be notched and/or elastic, cord or string means, or a collar with openings for receiving the legs therein may be utilized.

Figure 3:
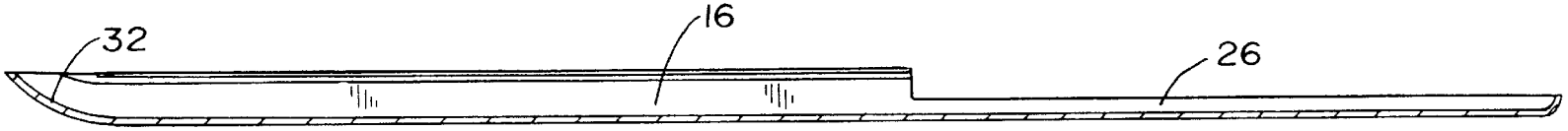
FIG. 3 is a side and top view of the dispensing leg of the present invention.
Figure 7:
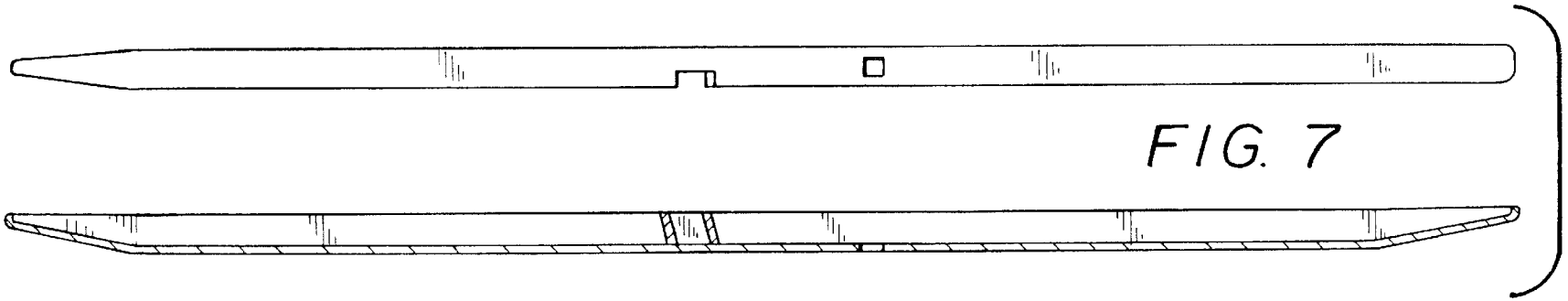
FIG. 7 shows details of the support legs.
Figure 4:
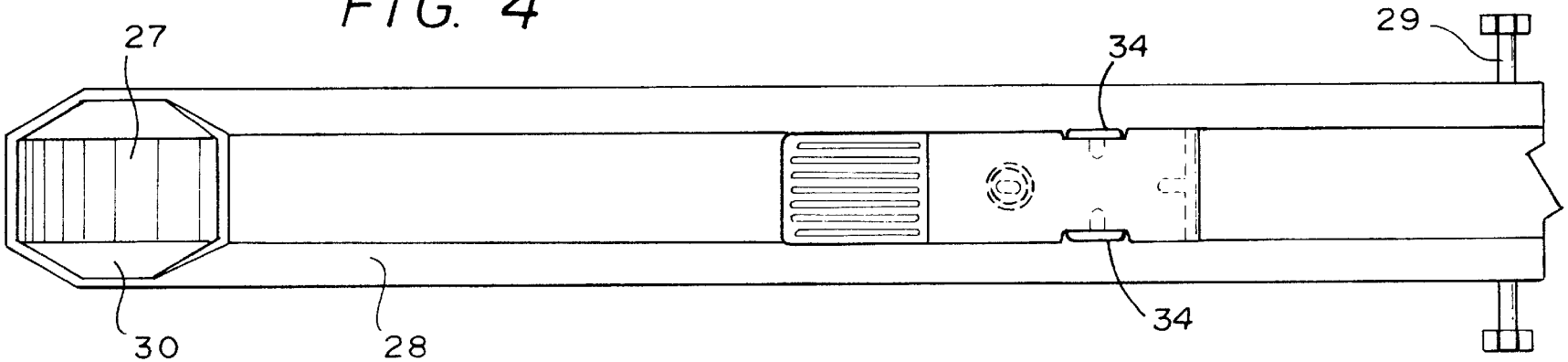
FIG. 4 is a further top view of the dispensing leg of the present invention showing the support flanges for the dispensing means.

As seen in FIGS. 3 and 4, the chute leg 16 has its upper portion 26 formed in an almost flat arcuate configuration with the remaining portion 28 being tubular 27 to facilitate the passage of ball 21 therethrough. As with legs 12 and 14, chute leg 16 may be made of any material and may alternatively be trough-shaped as the consideration is to constrain the golf balls 21 therein.

Figure 5:
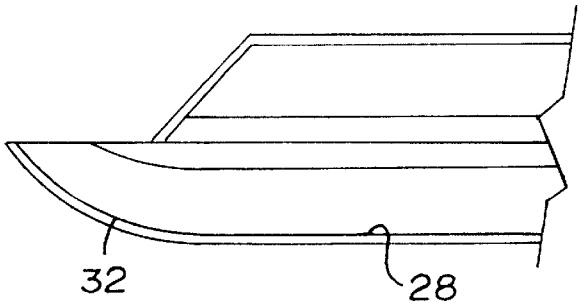
FIG. 5 is a partial view of the lower section of the dispensing leg.

With continuing reference to FIGS. 3 and 4, the chute leg 16 is also provided with a pair of opposed rods or extensions 29, 29 disposed adjacent the upper and lower sections 26, 28 which are utilized in the assembly process. Additionally, the terminal end 30 of section 28 is curved at 32 to permit the smooth egress of the ball therefrom, see FIG. 5. If chute leg 16 is made from flexible plastic or the like, the lower section 28 can be bent to control the descent of the balls therethrough.

Figure 6:
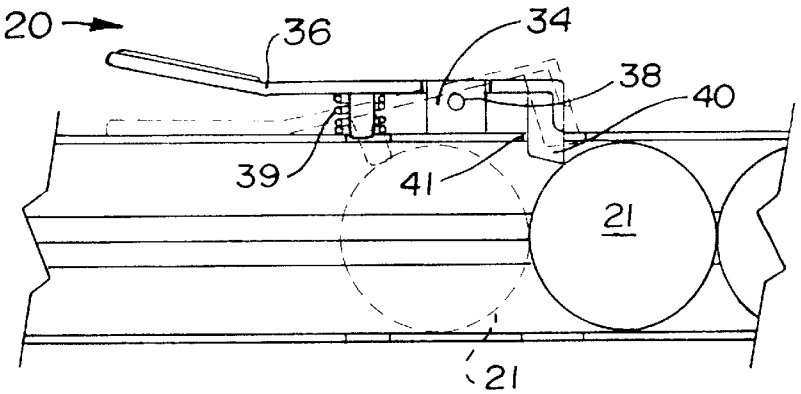
FIG. 6 is a top and side view of the dispensing means.

The chute leg 16 also supports the discharge means 20, see FIG. 6, which controls the individual dispensing of ball 21 from the supply SGB, and is seen to include a pair of spaced upstanding tabs 34, 34 and a pivotally mounted lever 36 at 38 therebetween. The lever 36 is biased upwardly at 39 and has a leg 40 at its other end extending downwardly through an opening 41 whereat it engages the lead ball 21 of a line of balls being fed from the hopper 18 as will be apparent hereinafter. In use, end 44 of lever 36 is engaged and depressed against the bias of spring 39 thereby raising leg 40 to permit the release of lead ball 21 for its passage down the chute leg 16. Releasing lever 36 returns leg 40 back into engagement with next lead ball 21.

To use the golf ball dispenser assembly 10 of the present invention, one grasps the legs 12 and 14, interfits them at their notches 22, 24, and then wedges the extensions 29, 29 onto chute leg 16 above the interfitment point of legs 12, 14 thereby forming a solid tripodal support. The supply hopper 18 which is of complimentary configuration to the upper part of the support is then placed in the recess formed thereby. The hopper 18 which is preferably fabricated from flexible material is provided with a pocket 46 or other retention means extending the length thereof to receive the upper section 26 of chute leg 16 therein. The free corners 48, 50 of hopper 18 are then secured to the ends of legs 12, 14 to maintain the same in place. Any suitable means may be utilized for securing the same, i.e., loops on the hopper engaging notches in the legs, cooperating Velcro® means disposed on the legs and ends respectively, screws and grommets, etc. The hopper is provided with an opening 52 which is disposed over the top section 28 of chute leg 16. The user places a supply of balls in the hopper where they will pass through opening 52 and form a stream of balls in chute leg 16. The golfer then depresses lever 36 at 44 with his golf club or foot whereby the lead ball 21 will be released and discharged smoothly from exit 32 of chute leg 16 into the striking area.

Alternatively, the assembly 10 can be preassembled by interconnecting the legs 12, 14 and disposing upper section 26 in the hopper 18 pocket 46 whereby the user merely erects the same and connects the free corners 48, 50 of hopper 18 to the top of legs 12, 14.

It is apparent then that the present invention is simple in construction, easily assembled and disassembled, compact, and energy and time saving to the user.

I claim:

1. A golf ball dispenser including:

a) a support comprised of at least three legs of substantially the same length, one of said legs being hollow and having an opening therein;

b) means interconnecting said legs generally medially thereof; said at least three legs being adapted to be extended from a collapsed position to an erected position whereby the upper portions form a support in mirror image of the lower portions;

c) a hopper adapted to be positioned within the upper portion of said legs to house a supply of golf balls, said hopper having an opening therein communicating with the opening of said hollow leg to thereby allow balls to enter therein;

d) discharge means located in the lower portion of said hollow leg;

e) control means to meter the selective discharge of individual balls.

2. The golf ball dispenser of claim 1 wherein the hopper is fabricated from flexible material and engages the upper leg portions thereby maintaining the same in an open position.

3. The golf ball dispenser of claim 2 wherein the control means is a pivotally mounted lever selectively moveable into and out of said hollow leg to alternately dispense one ball while blocking the next ball to be dispensed.

4. The golf ball dispenser of claim 3 wherein the control lever is biased to said blocking position.

5. A golf ball dispenser for the individual discharge of balls including three legs, means interconnecting said legs generally medially thereof to form a tripodal support, a flexible hopper disposed in said support above said interconnecting means, means connecting said hopper to said legs above said interconnecting means, one of said legs being hollow and forming a discharge chute, said hopper having an opening communicating with said hollow leg whereby a stream of balls will be fed there into, and means on said hollow leg controlling the discharge of individual balls therethrough.

* * * * *